US010304424B1

(12) United States Patent
Baker

(10) Patent No.: US 10,304,424 B1
(45) Date of Patent: May 28, 2019

(54) GUITAR PICK

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 0 days.

(21) Appl. No.: 15/808,660

(22) Filed: Nov. 9, 2017

Related U.S. Application Data

(60) Provisional application No. 62/421,813, filed on Nov. 14, 2016.

(51) Int. Cl.
*G10D 3/16* (2006.01)
*G10G 5/00* (2006.01)

(52) U.S. Cl.
CPC ..... *G10D 3/163* (2013.01); *G10G 5/00* (2013.01)

(58) Field of Classification Search
CPC ..... G10D 3/163; G10G 5/00
See application file for complete search history.

(56) References Cited

U.S. PATENT DOCUMENTS 4,790,227 A * 12/1988 Lukehart ..... G10D 3/163 84/322
7,626,103 B1 * 12/2009 Phillips ..... G10D 3/163 84/320
9,153,213 B2 * 10/2015 Storey ..... G10D 3/163

* cited by examiner

*Primary Examiner* — Kimberly R Lockett
(74) *Attorney, Agent, or Firm* — Colin P. Abrahams

(57) ABSTRACT

A guitar pick and case assembly comprises a guitar pick having a front end for engaging the string of a musical instrument and a rear end for engaging a case. The case for accommodating the guitar pick comprises a chamber and a slot for providing access to the chamber, the case releasably accommodating the guitar pick.

27 Claims, 19 Drawing Sheets

GUITAR PICK

CROSS-REFERENCE TO RELATED APPLICATIONS

This application claims the benefit of U.S. Provisional Patent Application No. 62/421,813 filed on Nov. 14, 2016, the contents of which are incorporated by reference in their entirety.

FIELD AND BACKGROUND OF THE INVENTION

This invention relates to a guitar pick.

Music and the elements to create that expression have been in existence for as long as history can document. Stringed instruments, specifically guitars, have a very long and storied history in human existence, taking thousands of different shapes and styles over the years to suit individual tastes both visually and sonically.

The guitar pick has been the object of choice to allow a player to easily affect the strings of the instrument thus creating music.

As with many things, evolution of man-made objects is ongoing. With music and specifically music created through a guitar, the guitar pick itself has evolved to allow for a wider range of music to be created, from "rhythmic" strumming and harmonies to the harder and more driving "lead" picking. The main differentiator is, in many instances, the thickness of the actual guitar pick. When a musician performs the "lead" parts of music, the guitar pick is of a thicker nature allowing for a harder more crisp and clear tone from the instrument. Also, "lead" is typically played at a faster pace with the guitar pick being held very tightly and near the edge of the pick itself reducing pick flexibility. When a musician performs the "rhythm" parts of music, the guitar pick is of a thinner nature allowing for a softer smoother tone from the instrument.

While there are several thicknesses of picks to choose from the majority of guitar picks tend to fall into one of two thickness categories.

Additionally, guitar picks are generally small and, in practice, can easily be misplaced or lost. As a result, musicians have to continually purchase new or replacement picks. Even more disconcerting for a guitar player may be a situation where he or she is setting up to play at a show or concert, and realizing at the last moment that a pick has been misplaced, and that there may not even be a spare pick for immediate use.

There has long been a need for musicians to play music switching back and forth from a "lead" position to a "rhythm" position without having to switch picks. There are also substantial advantages to providing a mechanism or system in which a guitar player may secure or store a guitar pick in a convenient location so that it is always consistently available and ready for use.

Additionally, while it has always been challenging for musicians to make a living at their craft, with the creation of the internet over the last 20 years it has been easier for musicians to garner exposure and increase their fan base. At the same time, this may offer the same opportunities to every musician on the planet potentially voiding any advantage to a single musician. What has been advantageous is the ability to sell merchandise to fans without having to tour with concerts which is an expensive ordeal and difficult for the vast majority of musicians. There has, as such, long been a need for a simple and inexpensive way for musicians to promote themselves with merchandise that fans can purchase easily and cheaply, and that musicians can produce relatively inexpensively with minimal or very low costs.

SUMMARY OF THE INVENTION

In accordance with the present invention, a guitar pick (which may be referred to as a "Flipper" pick or Flip Ik) and case or container for the guitar pick offers string musicians the option of playing rhythm and lead guitar parts with one pick. By utilizing the qualities of two different types of picks in one component the artist can effortlessly move from performing one type of musical interpretation to another without skipping a beat. A single guitar pick, configured in accordance with the present invention, may be used in different ways as will be described so that there is no need to change picks when the musician shifts between playing the so-called "lead" and "rhythm" music types.

Additionally, an advantage of the present invention is that it may offer reassurance of an emergency "back up" pick (in case the primary pick gets lost just before performance time) that affords the musician comfort in the knowledge that if the worst case scenario occurs and the pick is lost, there is a guaranteed back up plan that is always at the ready.

This combination of pick and case in accordance with one aspect of the invention can be utilized separately as well as in unison allowing for a myriad of combinations.

Additionally, since the guitar pick of the invention may in one embodiment be a little larger than conventional guitar picks, this allows for promotions to be printed on one or both sides of the pick, as well as the case therefor, allowing musicians to convert this unique tool of their craft into inexpensive merchandise that can be easily produced and inexpensively sold to fans via the internet or at local shows.

In utilizing the current invention as a marketing tool, the technology allows for the shape of the guitar pick and case of the invention to be converted and applied so as to be venue specific, event specific, as well as industry specific.

Changing the exterior shape of the pick and case for a particular sporting industry may also be a feature of the present invention. As one example, baseball allows that venue to capitalize on the public's ever growing need to have something in their hands to fiddle with, or to provide a memento. The original fiddle tool is the guitar pick, since many love playing with guitar picks and while people may fiddle with a pick, they cannot help but look at whatever might be printed on it, making it a perfect item for marketing and promoting oneself or an event or a company, to name some examples only.

The ability to change the exterior shape is yet another option the present invention offers. Further, the nature of the larger size may allow for the marketing aspect to come into play.

DETAILED DESCRIPTION OF THE INVENTION

Reference is now made to the accompanying drawings, which show different embodiments of a guitar pick, a guitar pick case, and a guitar pick and case assembly, in accordance with the present invention. While specific examples are illustrated, it should be appreciated that the invention is not limited to these embodiments, and the guitar pick and case may assume many different shapes and configurations within the scope of the invention.

Figure 1:
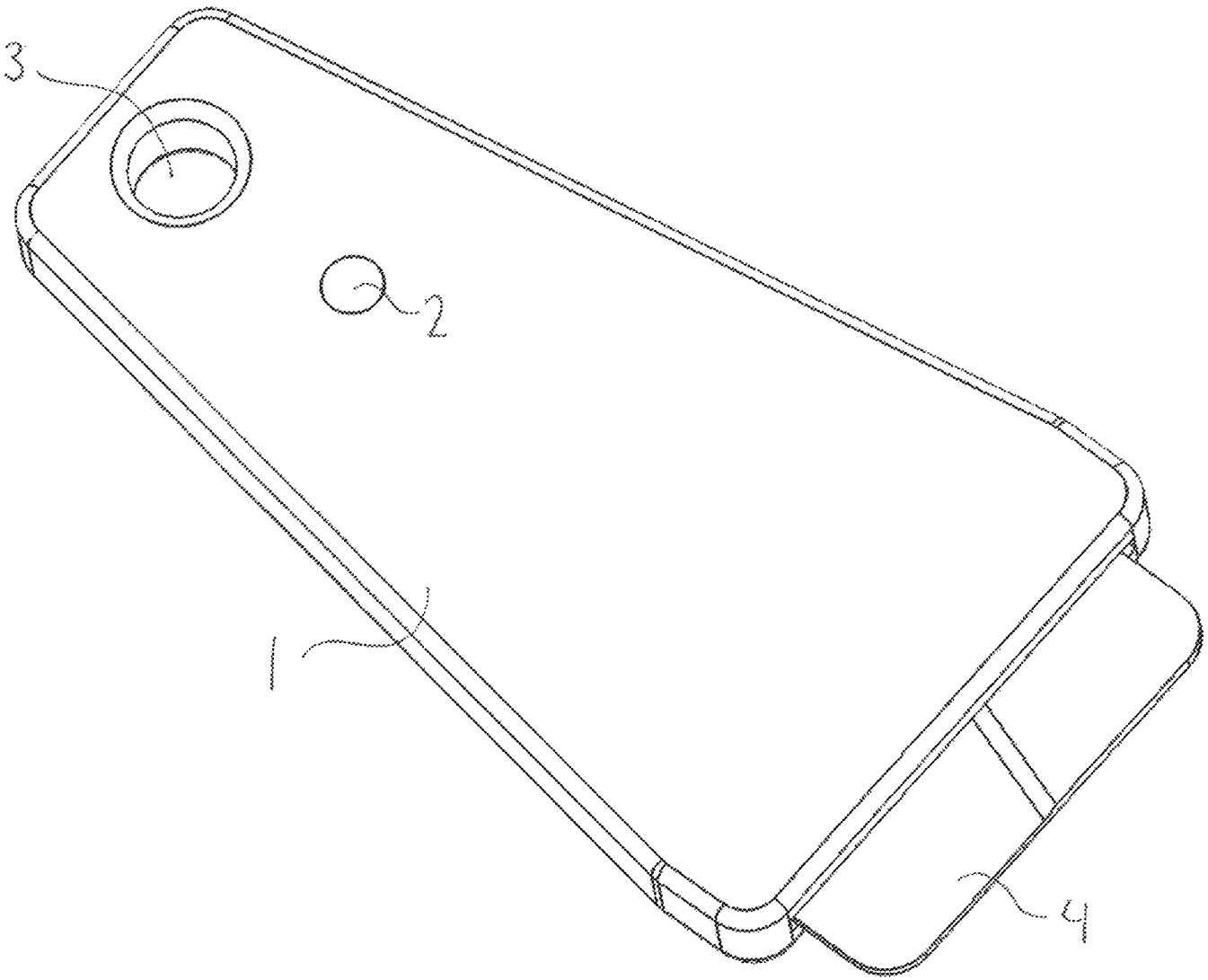
FIG. 1 is a perspective view of a guitar pick and case assembly in accordance with one aspect of the invention.
Figure 2:
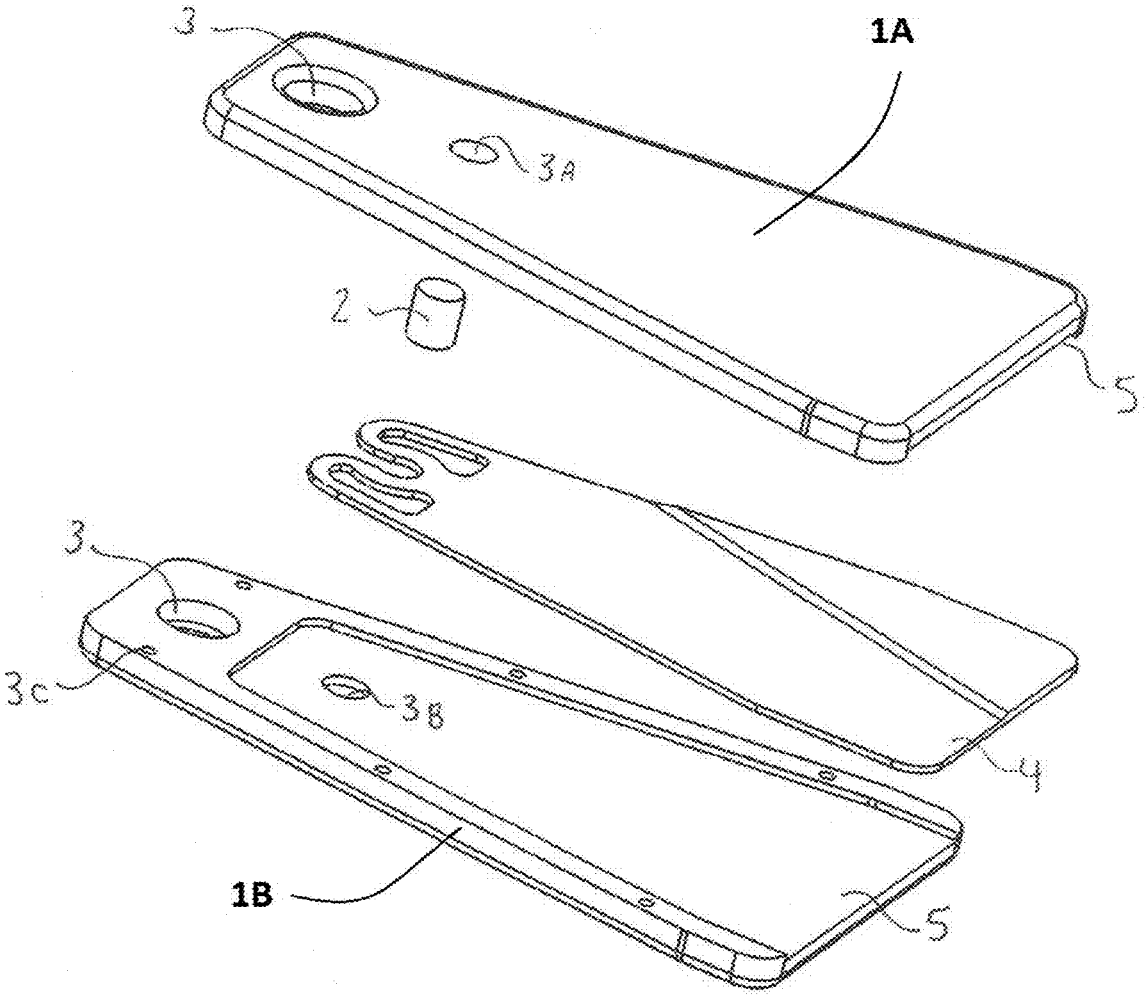
FIG. 2 is an exploded view showing the parts and components of a guitar pick and case assembly as shown in FIG. 1 of the drawings.

FIG. 1 of the drawings shows an embodiment of a guitar pick and case assembly comprising a case 1 including an internal pick mounting post 2, a case mounting hole 3, and a guitar pick 4 which is substantially contained within the case 1. FIG. 2 of the drawings shows an exploded view illustrating the parts and components of the pick and case assembly of FIG. 1, further showing the guitar pick case female side 1A, the guitar pick case male side 1B, and the guitar pick mounting post 2 which is supported between an indentation 3B and the mounting post through hole 3A. The guitar pick 4 is shown, and is received within the pick mounting slot 5. The guitar pick 4 itself has at one end a slotted configuration for releasably engaging with the mounting post 2.

Figure 3:
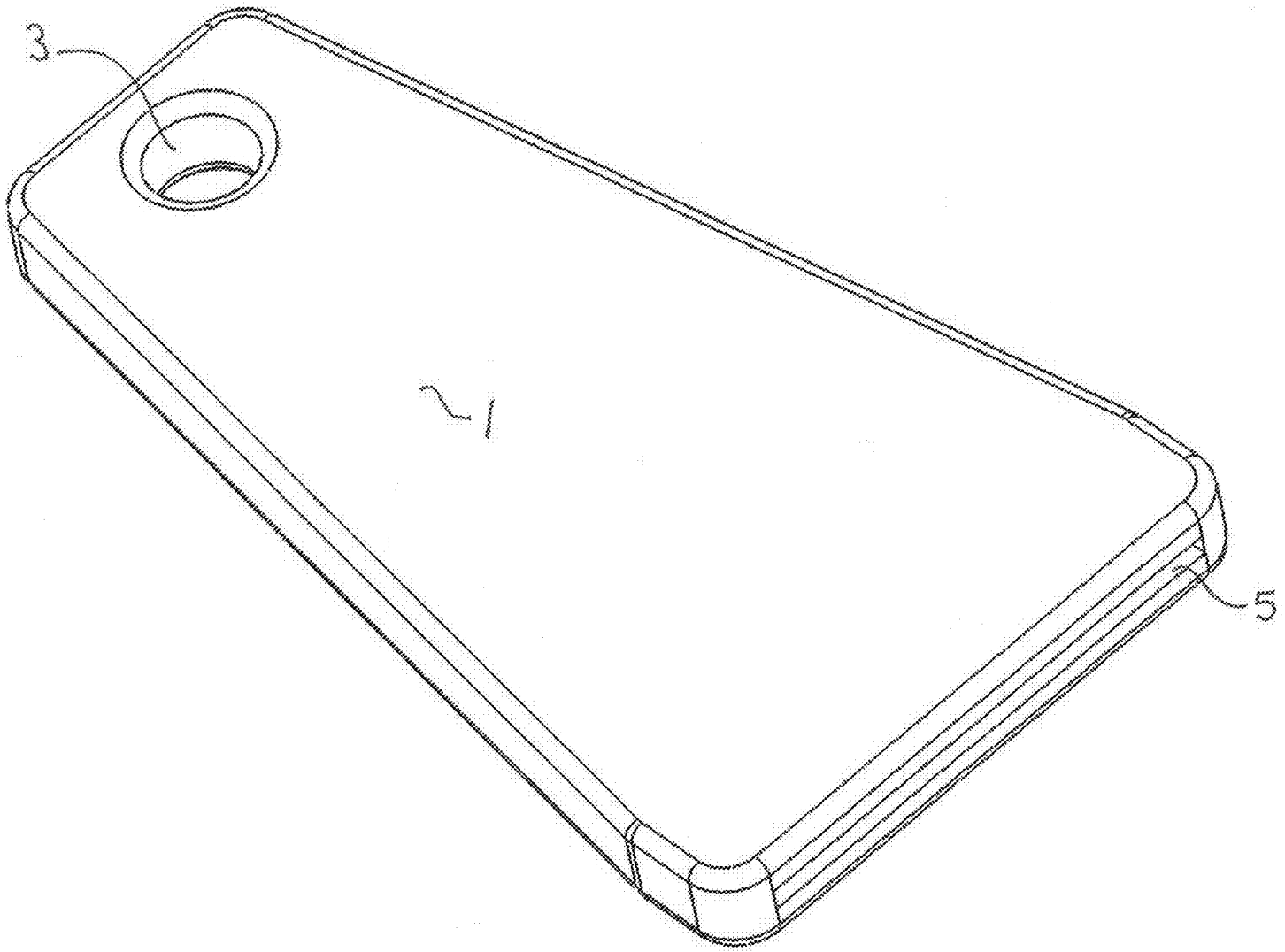
FIG. 3 is a perspective view of a guitar pick case in accordance with the invention.

FIG. 3 is a perspective view of the case 1, and further illustrates the mounting hole 3. The mounting slot 5 at the expanded end can be seen, through which the guitar pick 4 can be inserted and removed.

Figure 4:
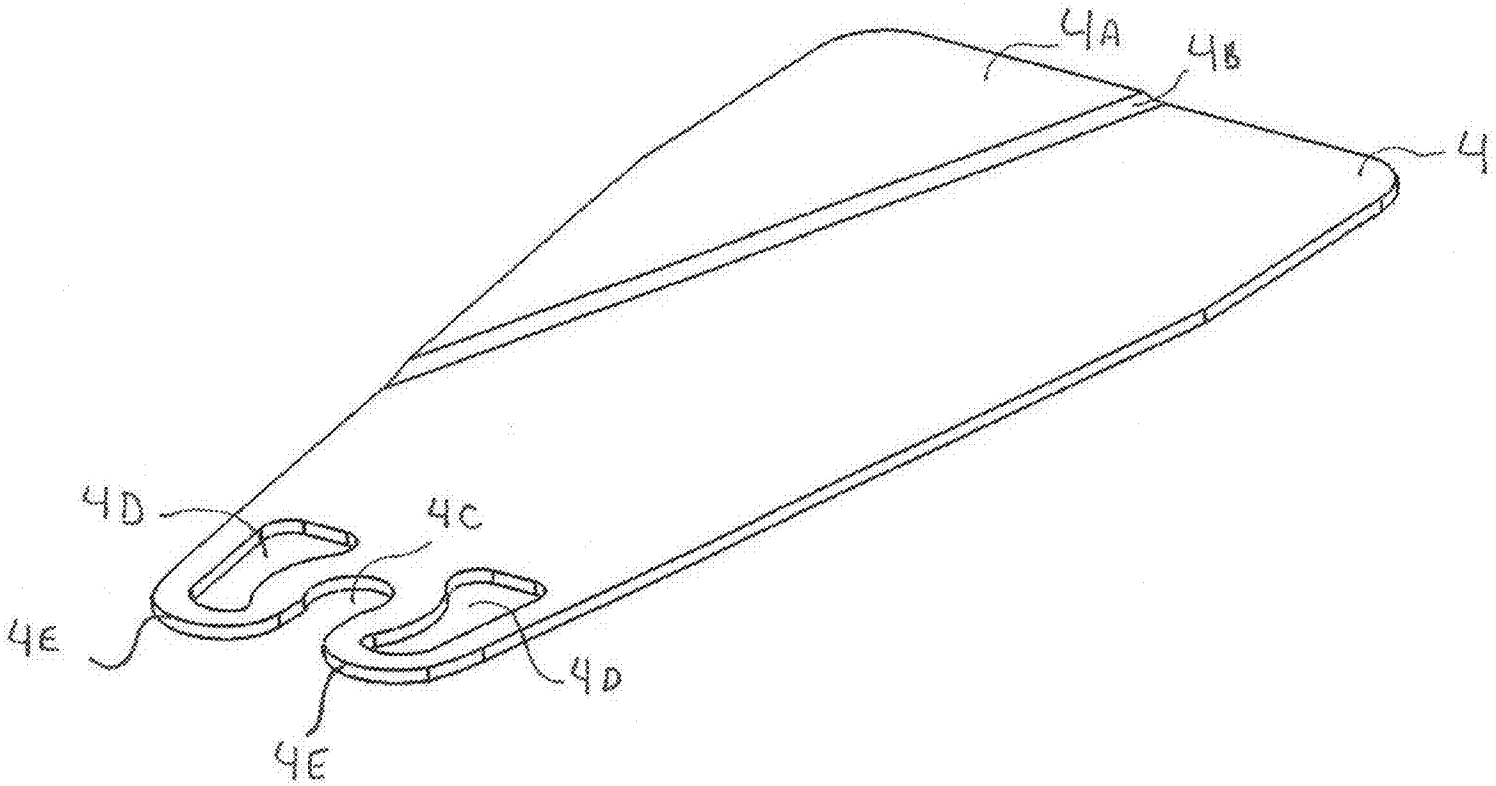
FIG. 4 is a perspective view of a guitar pick in accordance with one aspect of the invention.
Figure 5:
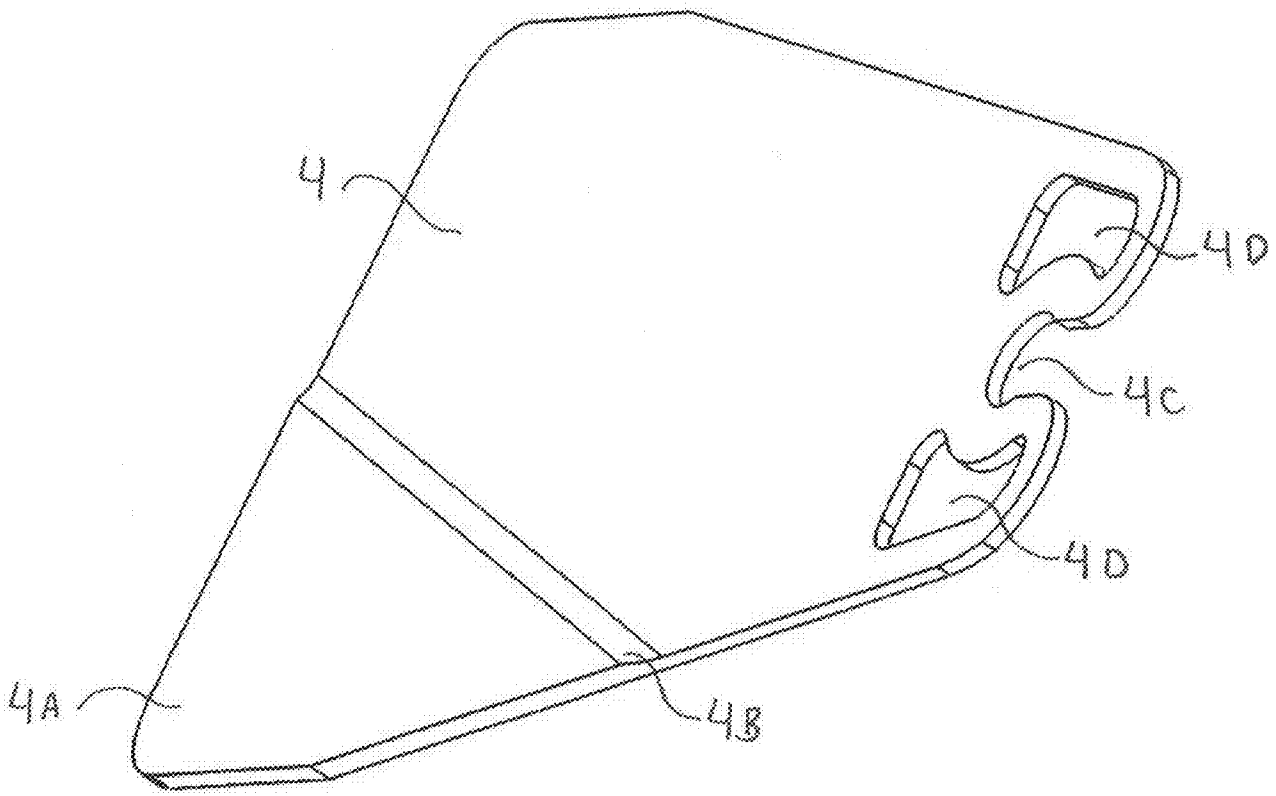
FIG. 5 is a further perspective view of a guitar pick as shown in FIG. 4 of the drawings.

FIG. 4 shows a guitar pick in accordance with one aspect of the invention. The guitar pick 4 is shown of fairly consistent thickness, but further comprises an enhanced or increased thickness area 4A. An elevation or incline 4B can be seen interjacent the enhanced thickness area 4A and the remainder of the pick 4 which has the reduced thickness. At one end, the pick 4 includes guidance curves 4E and mounting post engagement relief areas 4D. Centrally, there is formed a mounting post engagement area 4C, which has a slightly narrower and resilient portion, so they can engagingly slide over the mounting post 2. FIG. 5 shows a different perspective view of this same guitar pick 4.

Figure 6:
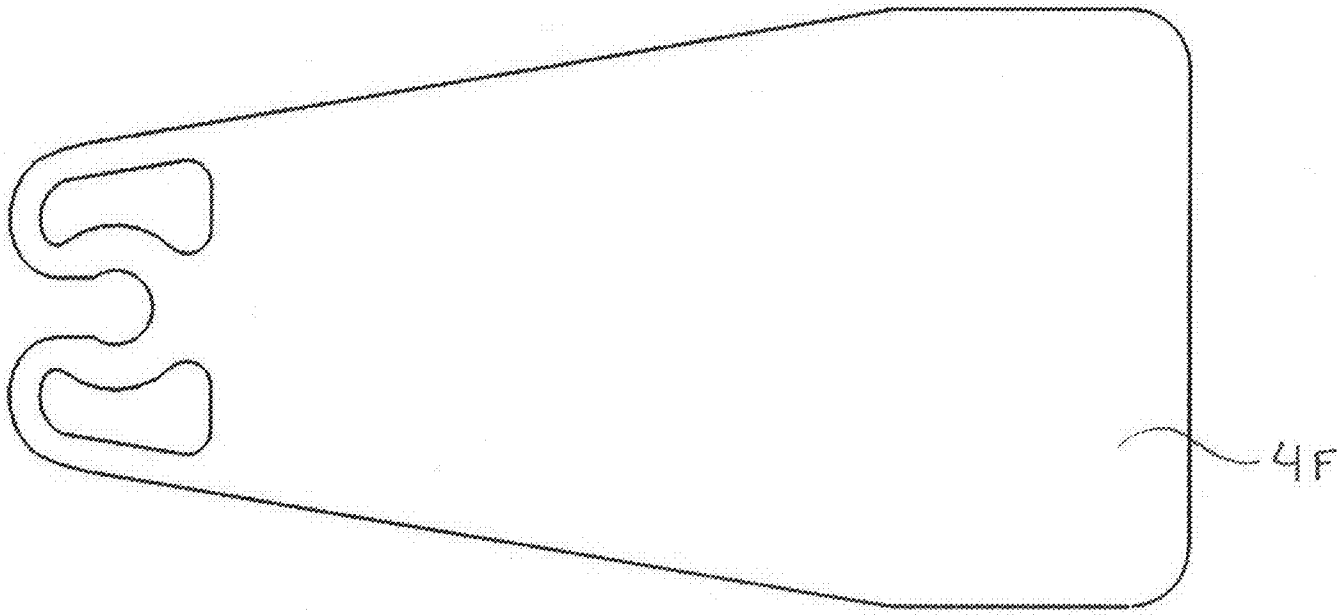
FIG. 6 is a bottom side view of a guitar pick in accordance with the invention.
Figure 7:
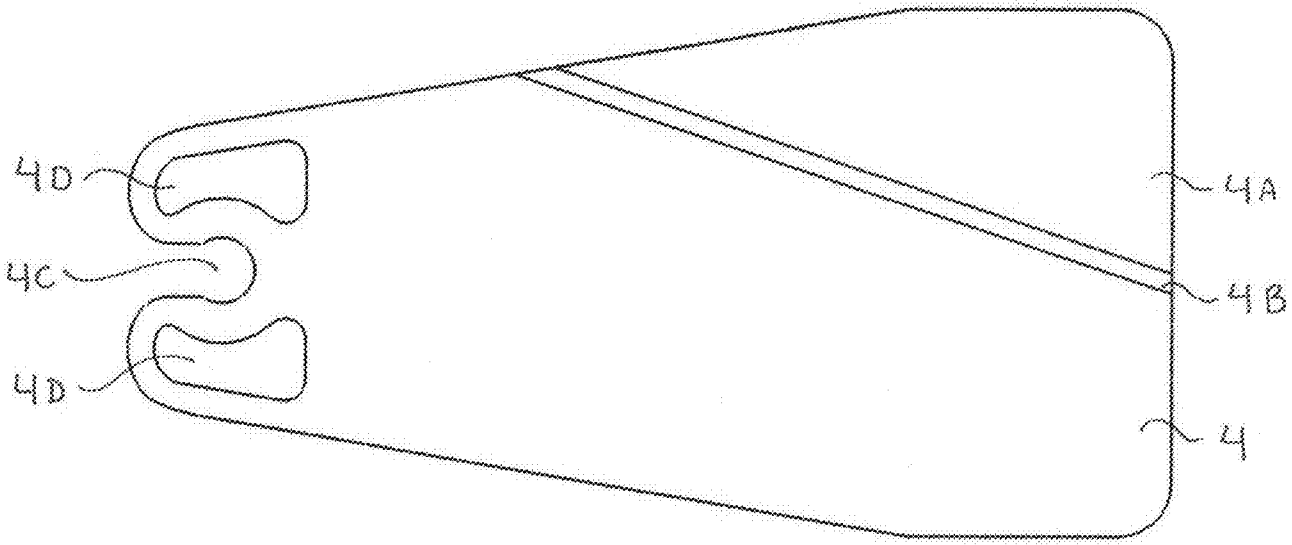
FIG. 7 is a top side view of a guitar pick in accordance with the invention.

FIG. 6 of the drawings shows the guitar pick 4, seen from its lower or bottom side 4F. It will be seen that the lower side 4F has a fairly consistently smooth surface. FIG. 7 of the drawings shows a top view of the guitar pick 4.

Figure 8:
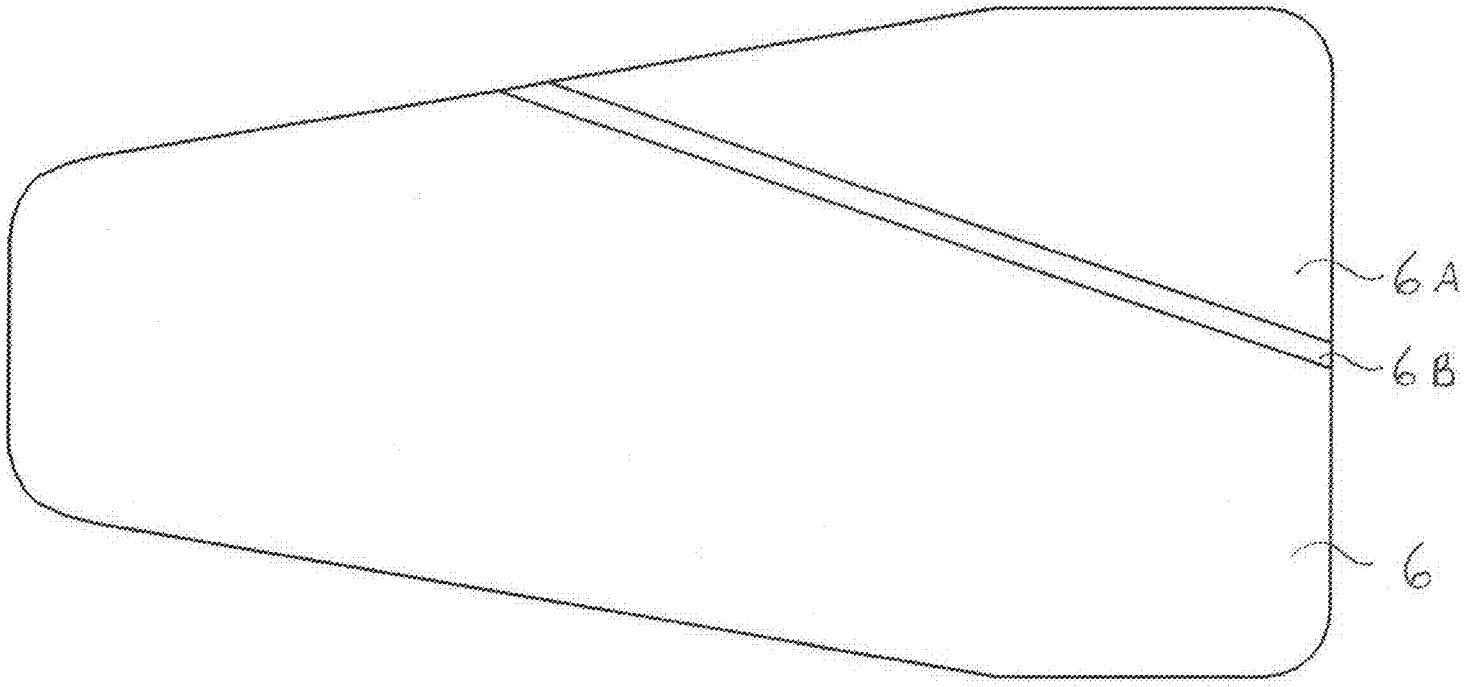
FIG. 8 is a top side view of a guitar pick of the invention with no case attachment mechanism.

FIG. 8 of the drawings shows a guitar pick 4, but without a case attachment mechanism. This guitar pick includes the enhanced thickness area 6A, the inclined or elevation area 6B, and the regular further part of the pick 6.

Figure 9:
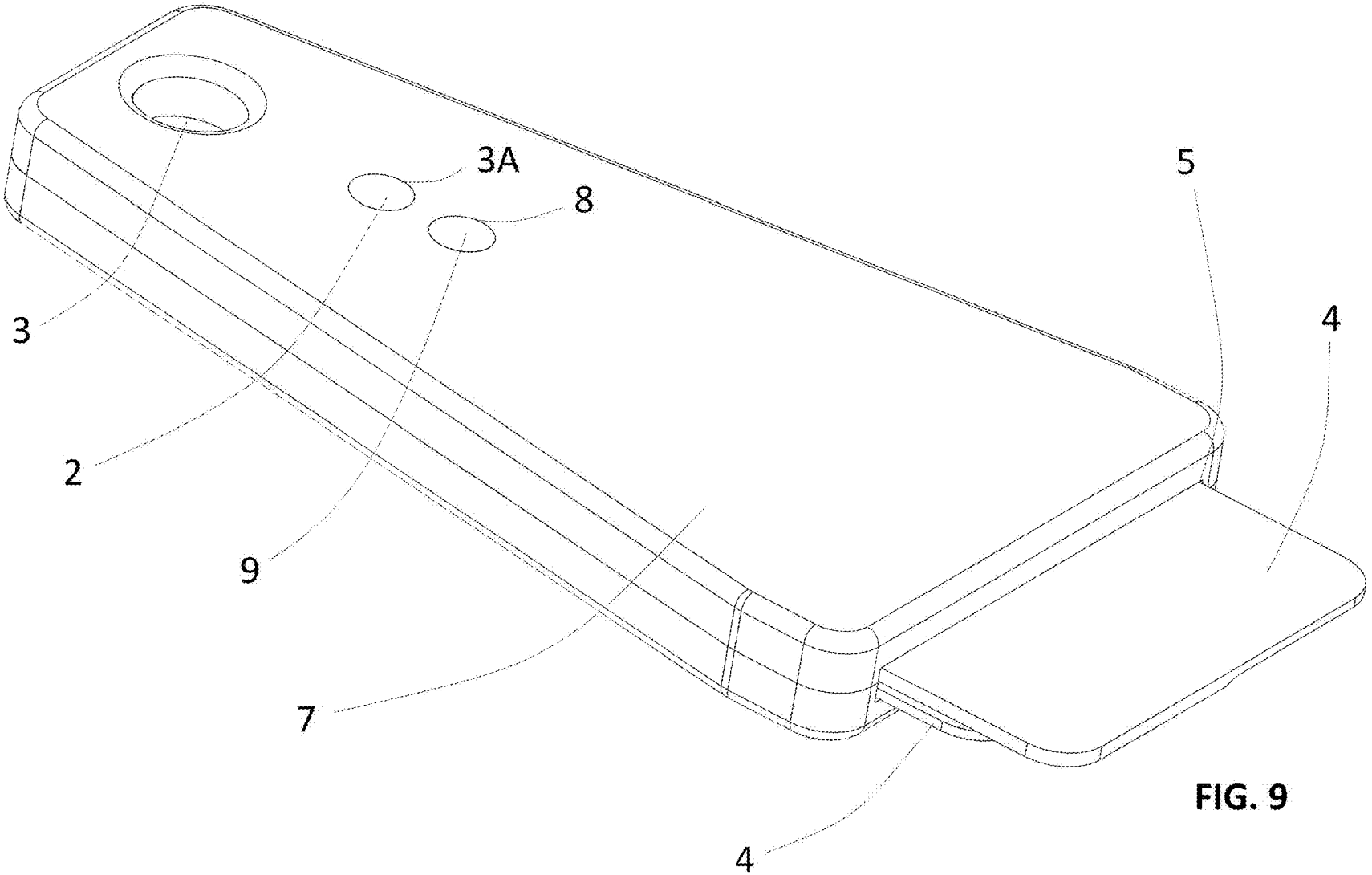
FIG. 9 is a guitar pick and case assembly, showing multiple guitar picks accommodated within the case.
Figure 10:
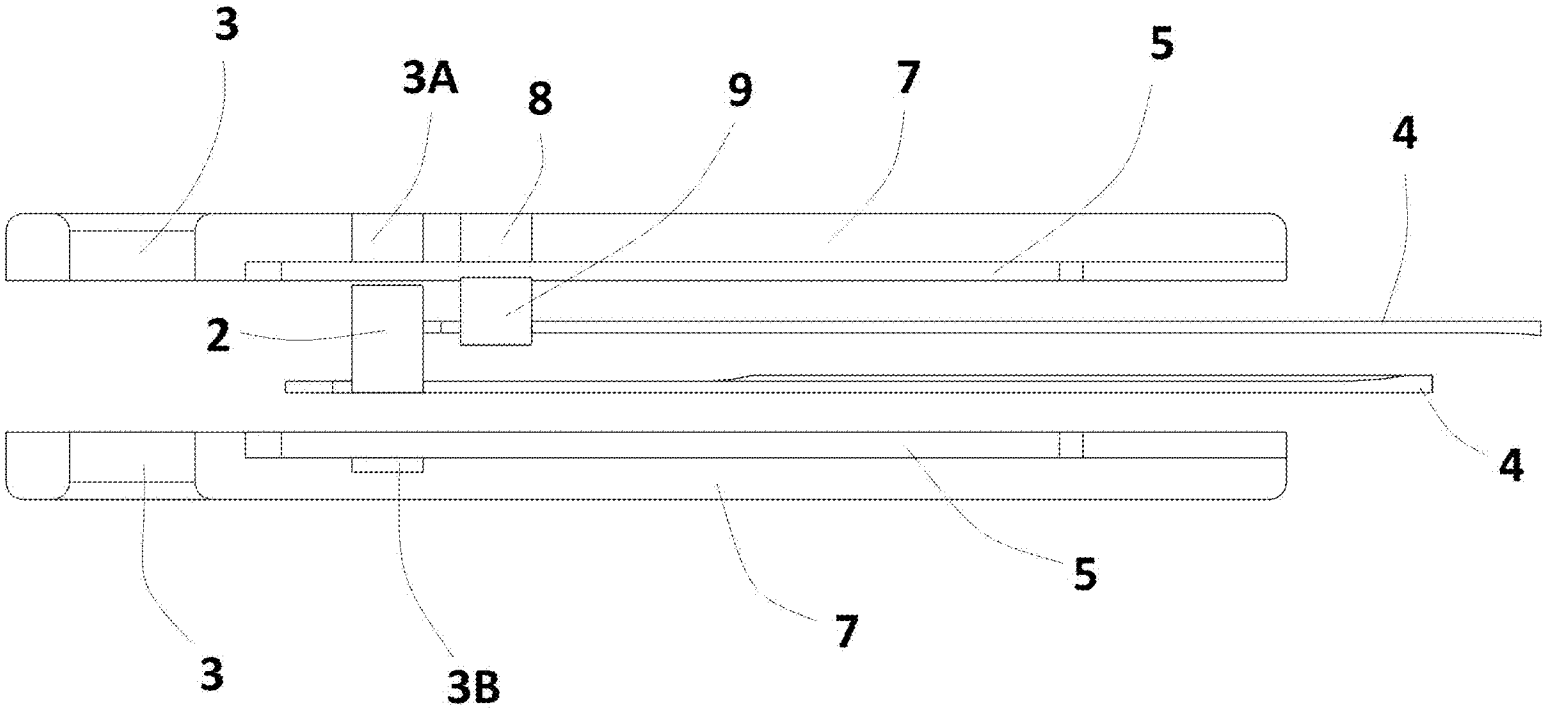
FIG. 10 is an exploded side view showing the various parts and components of the guitar pick and case of the invention as shown in FIG. 9 of the drawings.
Figure 11:
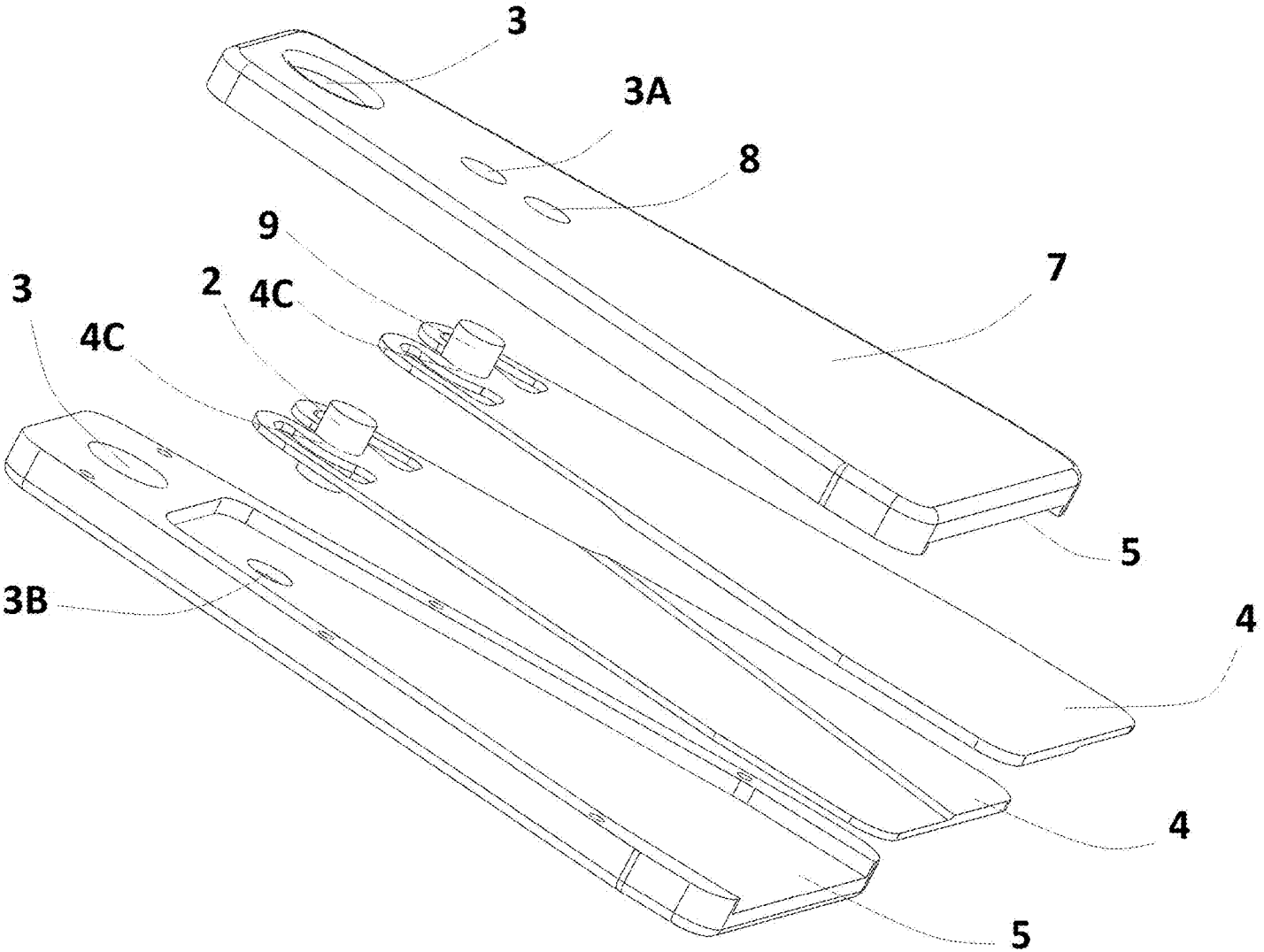
FIG. 11 is a perspective view, exploded with the various parts shown as shown in FIG. 9 of the drawings.

Reference is now made to FIG. 9 of the drawings, which shows a further embodiment of the invention. FIGS. 10 and 11 of the drawings also show different views of this embodiment. FIG. 9 shows a dual pick guitar case 7. This guitar case 7 includes a pick post 2, a key ring mounting hole 3, and the pick post hole 3A. Two guitar picks 4 are accommodated within the guitar pick case, inserted through the guitar pick mounting slot 5. The dual pick guitar case 7 in this embodiment also incorporates a secondary pick post hole 8, and a secondary pick post 9.

In FIG. 10 of the drawings, which shows the exploded view of this embodiment, there is further shown the configuration whereby a lower pick 4 engages with the post 2, and the upper pick engages with the post 9. The post 2 is received within the mounting post indentation 3A.

FIG. 11 of the drawings is a perspective exploded view of this embodiment. It will be seen that there are two guitar picks, namely the upper pick and the lower pick. In this embodiment, the upper pick 4 is generally of uniform thickness, while the lower pick has the enhanced or elevated second portion, providing the guitar pick with the multi-application ability for utilization in different playing styles. Further, FIG. 11 illustrates the presence of the mounting post engagement area 4C.

The secondary pick post 9 is a shorter pick post, and does not engage with the lower half of the case. It only depends downwardly to about half way into the case slot area. As is evident from the drawings, this construction allows one pick to slide completely into the case slot and mount in the typical manner as shown in previous embodiments. The second or upper pick engages with the pick post. This configuration allows for each pick to be removed separately and individually without disturbing or dislodging the other.

Figure 12:
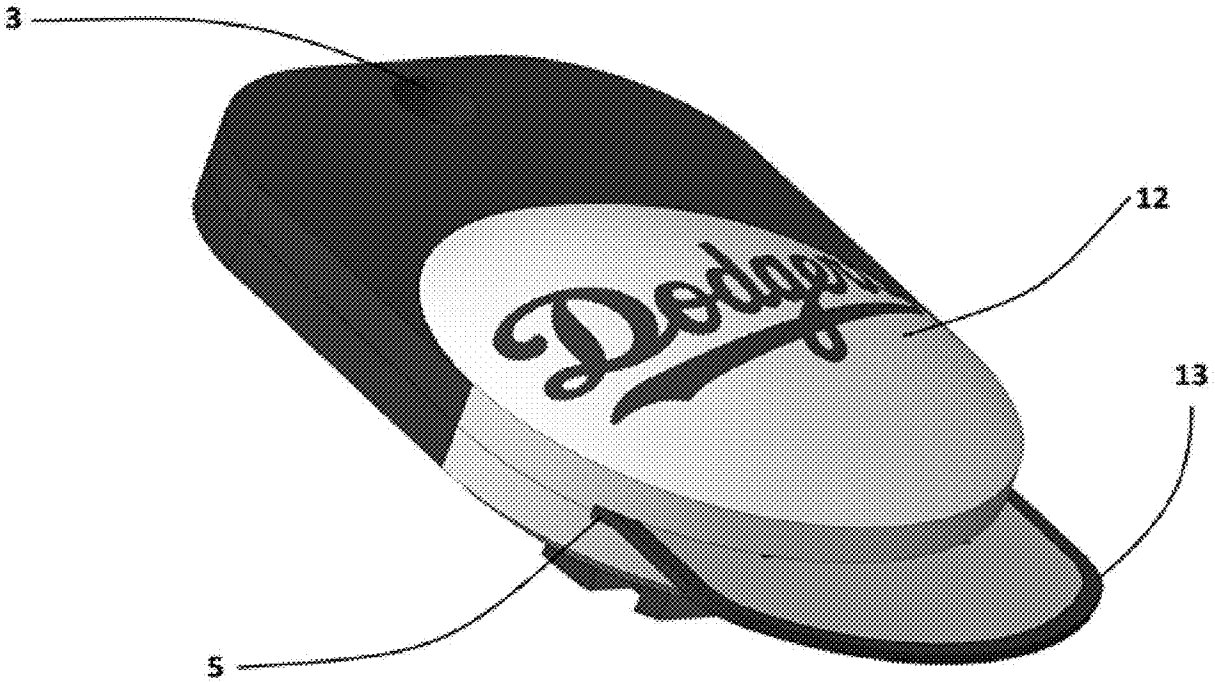
FIG. 12 shows a guitar pick and case of the invention including advertising material thereon.

FIG. 12 shows an embodiment illustrating advertising material on the case. A key ring mounting hole is shown, as is a printable surface 12 on the pick case, and a printable surface 13 on the guitar pick itself. The slot 5 is also illustrated. The case of this embodiment has a powerful baseball domed shape making it industry-specific.

Figure 13:
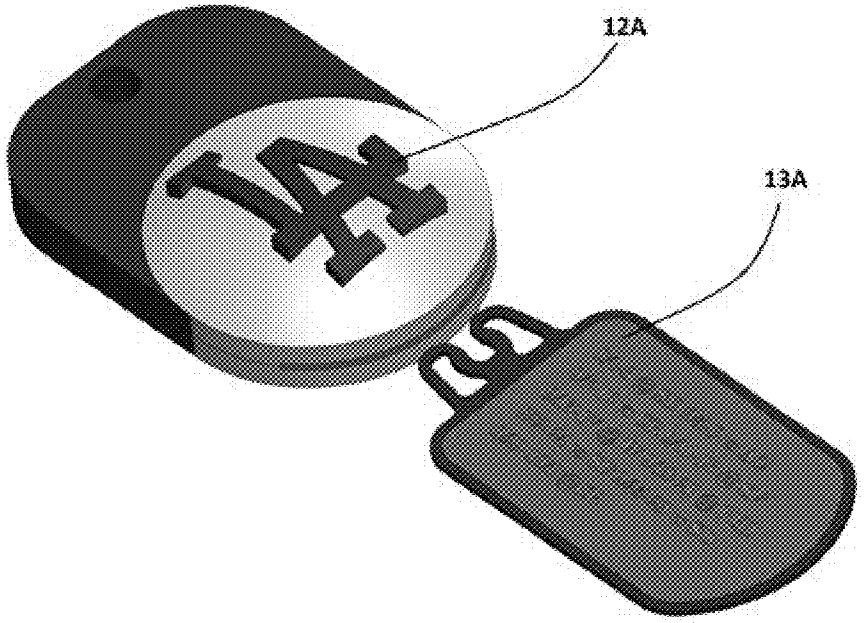
FIG. 13 shows a guitar pick and case of the invention, separate from each other, with advertising material on the guitar case.
Figure 14:
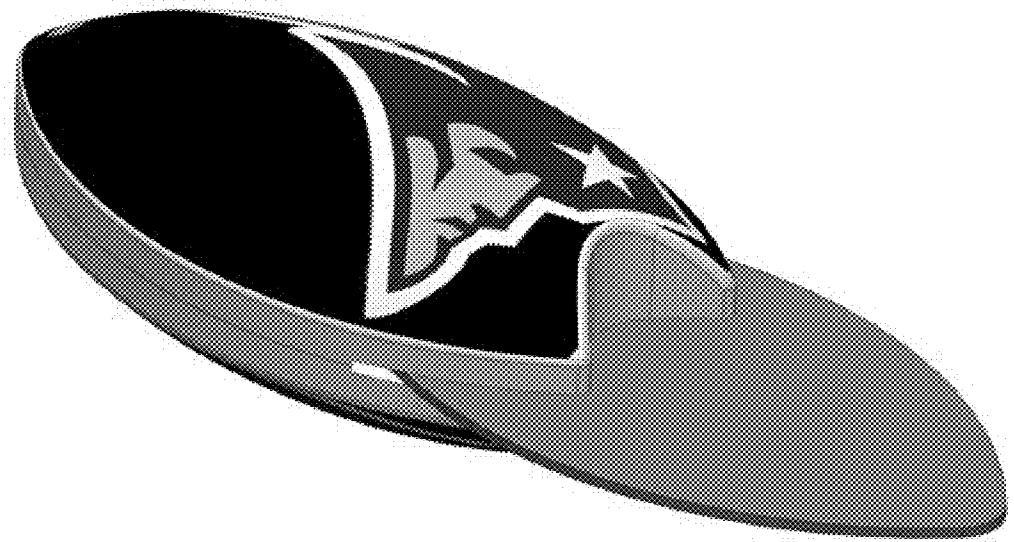
FIG. 14 is a perspective view of a further embodiment of a guitar pick and case assembly of the invention showing a specific shape which may be used for an event.
Figure 15:
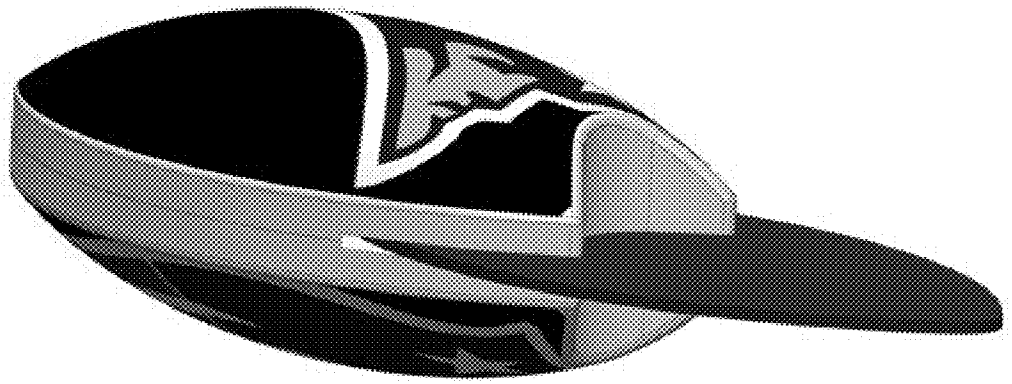
FIG. 15 is a different perspective view of the embodiment of the guitar pick and case assembly as shown in FIG. 14.

FIG. 13 shows the opposite side of the pick case illustrated in FIG. 12. It should be noted that the case in this embodiment has a specific logo 12A molded directly into the case and then further printed upon, an example of an industry specific embodiment. The additional printing surface 13A on the guitar pick itself in this embodiment may be utilized to print a team's schedule. FIG. 14 shows a case for a guitar pick, the case being shaped more or less in the form of a football. The guitar pick also takes the overall shape of a one dimensional football. FIG. 15 shows a slightly different view of the assembly illustrated in FIG. 14.

Figure 16:
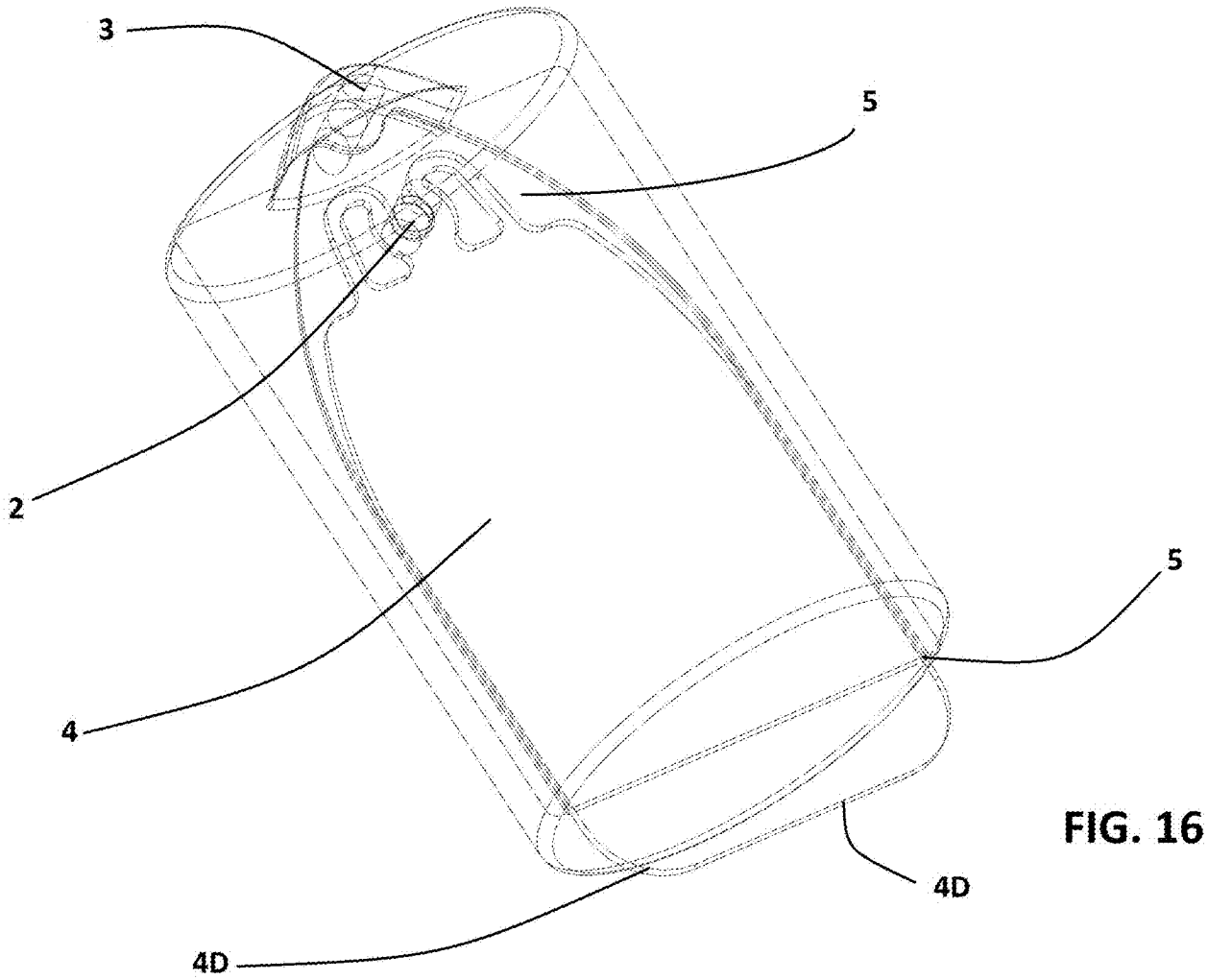
FIG. 16 is a schematic perspective view showing a guitar pick and case assembly in accordance with a further embodiment of the invention.

FIG. 16 of the drawings shows a schematic view of a further embodiment of the invention, including the guitar pick 4 located within the pick case. The pick case is generally cylindrical in shape. This figure also illustrates the pick post 2 for engaging the pick, as well as the key ring mounting hole 3. Contact points 4D are illustrated, showing those parts of the guitar pick 4 which engage and pick the strings of the instrument. The case includes the guitar pick mounting slot 5, as previously described and illustrated.

Figure 17:
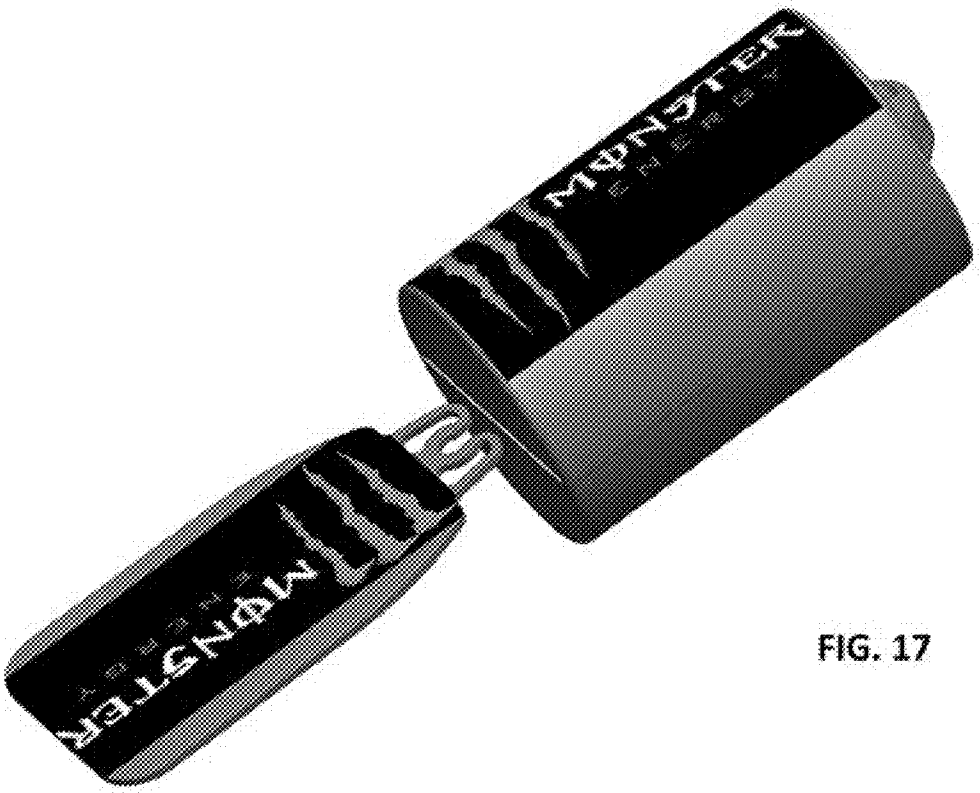
FIG. 17 is a perspective view of a guitar pick and case assembly of the invention configured to be of a specific shape for a selected use.

FIG. 17 shows a perspective view of a guitar pick and case similar to that shown in FIG. 16 of the drawings.

Figure 18:
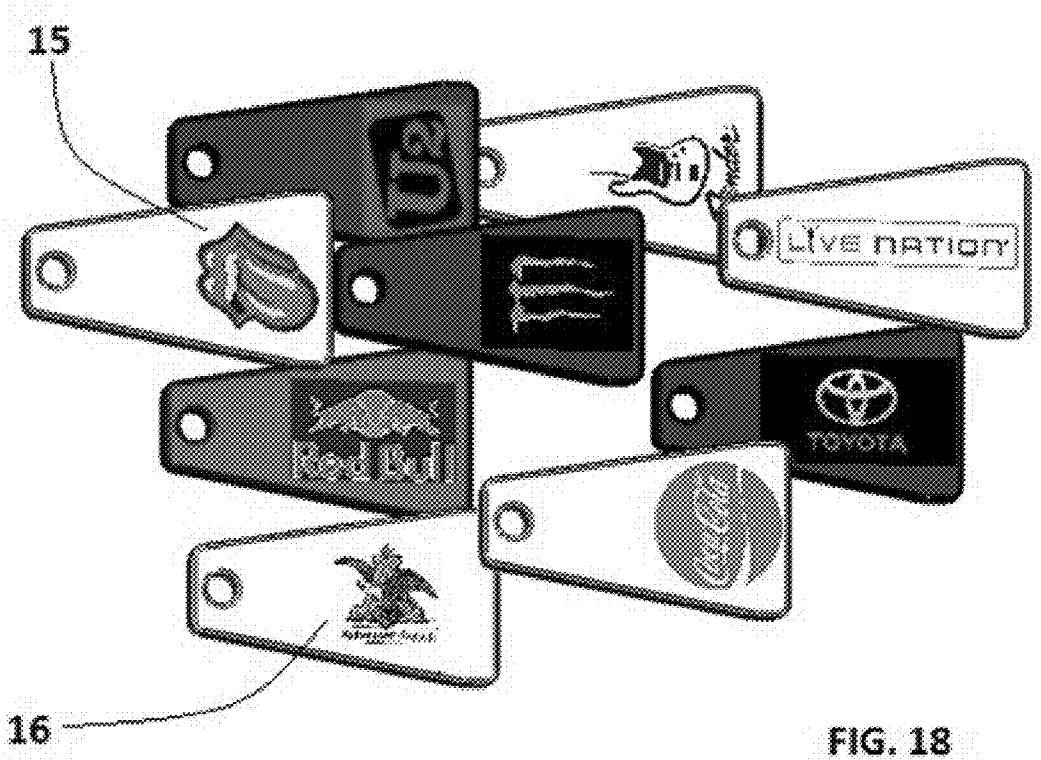
FIG. 18 shows a plurality of guitar pick cases of the invention including different types of advertising material which may be printed on one or both surfaces of the guitar pick case.
Figure 19:
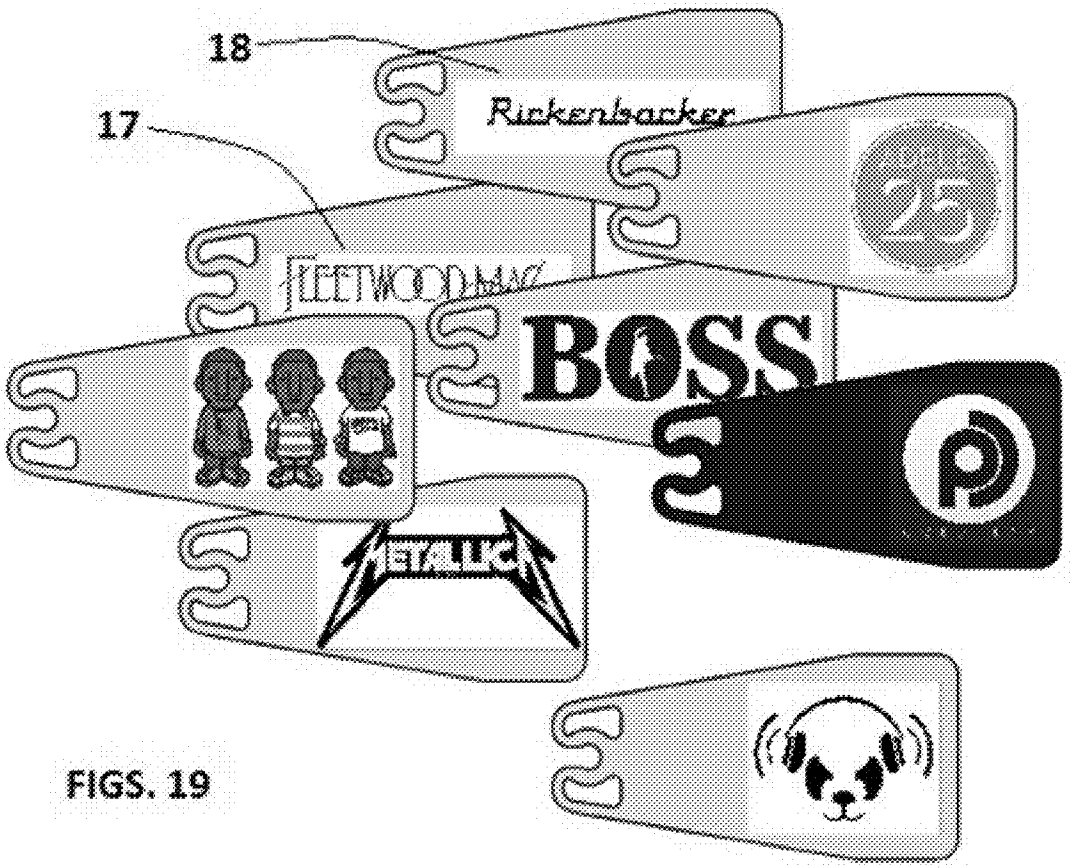
FIG. 19 shows a plurality of guitar picks of the present invention, configured in accordance with a further embodiment, with band logos of different musical groups and instrument companies shown printed thereon.

FIG. 18 shows a plurality of guitar pick cases, some with a band logo 15 printed, as an example. Another guitar pick case shows a company logo 16 printed thereon. FIG. 19 shows the guitar pick with a band logo 17, and a company logo 18.

The invention thus provides a guitar pick of substantially enhanced utility. The guitar pick has at its operating or active end varying thicknesses so that the end with the smaller thickness can be used in certain situations, such as "rhythm" playing, while the thicker part of the active end of the guitar pick can be used more effectively when playing "lead" type music. Further, the guitar pick can be contained within a case or container, which can itself be attached to another object, to ensure that the guitar pick is this likely to become lost or damaged. Another advantage is that both the guitar pick and the case can include printed material, including company logos, music venues, specific concerts, music bands, to name just a few examples, to spread or disseminate brand names and other information. The case itself can be in different shapes, forms and sizes to emulate products such as footballs, soda cans, and just about anything else, which may then comprise a novelty item which can be inexpensively sold or freely given out to promote a cause, sport or event.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A guitar pick and case assembly comprising:

a guitar pick having a front end for engaging the string of a musical instrument and a rear end;

a case defining a chamber and a slot for providing access to the chamber, the case releasably accommodating the guitar pick;

engagement means between the case and the guitar pick wherein the guitar pick is releasably retained inside the chamber when fully inserted therein through the slot, the engagement means comprising a post formed within the chamber of the case and a recessed area formed at or near the rear end of the guitar pick, the recessed area engaging with the post.

2. A guitar pick and case assembly as claimed in claim 1 wherein the guitar pick is substantially flat and of generally uniform thickness.

3. A guitar pick and case assembly as claimed in claim 1 wherein the guitar pick is substantially flat, and comprises a thinner portion comprising a majority of the guitar pick, and a thicker portion comprising a minority of the guitar pick.

4. A guitar pick and case assembly as claimed in claim 1 wherein the guitar pick is substantially flat and of generally uniform thickness between the front and rear ends thereof, the guitar pick having an increased thickness portion extending from the front end rearwardly over at least a part of the guitar pick.

5. A guitar pick and case assembly as claimed in claim 1 wherein the recessed area of the guitar pick has a resilient narrower neck portion having a diameter slightly less than that of the post such that the neck portion resiliently slides over the post when inserting or removing the guitar pick from the case.

6. A guitar pick and case assembly as claimed in claim 1 wherein the chamber is configured so as to accommodate two guitar picks.

7. A guitar pick and case assembly as claimed in claim 6 wherein the case comprises a first post for engaging the rear end of a first guitar pick and a second post for engaging the rear end of a second guitar pick such that the first guitar pick and second guitar pick may be separately inserted and removed from the case, and each independently held in an engagement position by the first and second posts respectively when fully inserted in the case.

8. A guitar pick and case assembly as claimed in claim 5 further comprising engagement relief areas near the rear end of the guitar pick substantially adjacent the recessed area.

9. A guitar pick and case assembly as claimed in claim 1 further comprising a case mounting hole.

10. A guitar pick and case assembly as claimed in claim 1 wherein the case comprises a female lateral side and a male lateral side fastened together to define the chamber and form the slot, and an indentation formed in one of the female or male lateral sides for accommodating a post.

11. A guitar pick and case assembly as claimed in claim 1 wherein the case comprises at least one surface containing printed or visual material.

12. A guitar pick and case assembly as claimed in claim 1 wherein the guitar pick comprises at least one surface containing printed or visual material.

13. A guitar pick and case assembly as claimed in claim 1 wherein the case is generally cylindrical in shape.

14. A guitar pick and case assembly as claimed in claim 1 wherein the case is shaped to resemble a football.

15. A guitar pick and case assembly as claimed in claim 1 wherein the case is shaped to resemble a baseball.

16. A guitar pick comprising a generally flat plate structure having four sides including a front end, a rear end, a left side, and a right side, a flat bottom surface and a top surface which has a raised portion at the front end, the raised portion creating a first thicker portion between the top and bottom surfaces, and a second thinner portion between the top and bottom surfaces, the first thicker portion and the second thinner portion between the top and bottom surfaces for usage on a stringed instrument independent of each other, the rear end of the pick having an engagement area shaped to snap around and pinch a lock post.

17. A guitar pick as claimed in claim 16 further comprising an inclined area between the first thicker portion and the second thinner portion.

18. A guitar pick as claimed in claim 16 wherein the lock post is contained within a carrier object, the carrier object comprising a case comprising a pair of substantially parallel sidewalls defining a chamber, and an access slot for inserting the guitar pick into the chamber, the lock post releasably engaging the engagement area of the guitar pick.

19. A guitar pick as claimed in claim 18 wherein the engagement member comprises a recess at or near the rear end side of the guitar pick, and the engagement member receiving means comprises a vertical post formed within the chamber.

20. A guitar pick as claimed in claim 16 wherein the first thicker portion and second thinner portion provide different musical effects.

21. A guitar pick as claimed in claim 20 wherein the first thicker portion is used for rhythm playing, and the second thinner portion is used for lead playing.

22. A guitar pick as claimed in claim 16 wherein the front end, rear end, left side, right side, flat bottom surface and a top surface are configured relative to each other so as to have a selected shape.

23. A guitar pick as claimed in claim 16 further comprising an indentation at the rear end thereof that expands from its rest shape to accommodate the lock post, and once expanded past a midpoint of the lock post as the pick is being engaged with lock post retracts to its rest shape enabling the pick to be securely engaged with the lock post.

24. A guitar pick as claimed in claim 16 further comprising a carry case, the carry case and guitar pick only engaging with each other by means of an indented receiving area on the guitar pick at its rear end, the case having an internal lock post that engages the indented receiving area of the guitar pick.

25. A guitar pick as claimed in claim 16 wherein the first thicker portion is stiffer and harder than the second thinner portion, and wherein the first thicker portion is used for playing lead guitar parts while the second thinner portion is used for playing rhythm guitar parts.

26. A method of producing a finished guitar pick in a single injection molding process that creates two thicknesses on one pick, both thicknesses being utilized for different tonal qualities when playing a stringed instrument.

27. A method as claimed in claim 26 further providing an engagement area that can flex to expand and then retract, both happening when the pick has its flexible area pressed against a locking post that resides inside a guitar pick case, expanding when pressed against the post and retracting once around the post, securing the pick inside the case releasable when firmly pulled upon at the opposite end of the engagement area.

* * * * *